United States Patent [19]

Tinnes et al.

[11] 4,091,971

[45] May 30, 1978

[54] MOLTEN METAL NOZZLE HAVING CAPILLARY GAS FEED

[75] Inventors: Bernhard Tinnes, Zollikerberg, Switzerland; Paul-Gerhard Mantey, Amberg, Germany

[73] Assignee: Metacon A.G., Zurich, Switzerland

[21] Appl. No.: 736,367

[22] Filed: Oct. 28, 1976

[30] Foreign Application Priority Data

Oct. 31, 1975 Germany ..... 2548854

[51] Int. Cl.[2] ..... B22D 41/08

[52] U.S. Cl. ..... 222/603; 222/600; 266/218; 266/236

[58] Field of Search ..... 266/218, 220, 221, 222, 266/223, 336, 236; 222/590, 600, 603; 138/40

[56] References Cited

U.S. PATENT DOCUMENTS

| | | | |
|---|---|---|---|
| 3,253,307 | 5/1966 | Griffiths et al. | 222/603 X |
| 3,581,948 | 6/1971 | Detalle | 222/600 X |

FOREIGN PATENT DOCUMENTS

| | | | |
|---|---|---|---|
| 566,383 | 7/1960 | Belgium | 266/218 |
| 1,910,707 | 7/1970 | Germany | 222/600 |

*Primary Examiner*—Allen N. Knowles
*Assistant Examiner*—David A. Scherbel

[57] ABSTRACT

A shaped refractory body having an elongated passage for the feeding of molten metal. At least one conduit is provided extending from the exterior of said body into communication with the passage for the introduction of a gas thereto. The conduit is reduced in diameter at least at its inner end adjacent the passage to the size of a capillary.

5 Claims, 3 Drawing Figures

MOLTEN METAL NOZZLE HAVING CAPILLARY GAS FEED

BACKGROUND OF THE INVENTION

The present invention relates to the construction of a firebrick member such as nozzles valves, spouts, ladle lips, or the like and particularly to such members made from ceramic sinterable material having passage opening for the delivery of molten metal and feed conduits for the introduction of a treatment gas.

In the casting of metals, vessels such as ladles and tundishes (used in continuous casting procedures) are employed to hold quantities of the molten metal from which a given charge may be caused to flow and be fed in a generally quantatively controlled manner into a suitable mold. The outlet from such vessels or ladles are generally provided with a shaped refractory brick having a passage or duct for the molten metal. Such bricks are made from high-grade, wear-resistant material. These shaped bricks can take many forms, as for example, a ladle or tundish nozzles, immersion nozzles, or parts of sliding gate valves having nozzle bricks, nozzle brick inserts, bottom plates, slide plates and chute nozzles. It is common to all of these brick members that they have a passage opening for the molten metal and therefore at least in the area which comes into contact with the melt during casting, is subject to erosion and damage.

Furthermore, during the pouring of molten metal, particularly steel, there is often a need to treat the melt with a gas immediately before or at the time that it leaves the vessel. For example, inert gases are used to prevent oxides from being deposited in the passage opening or to aid in the separation of oxide particles from the surface of the fire brick. For further example, the feeding of oxygen to the molten metal leads to a more intense boiling of the unkilled melts held in the passage, or to a reburning of the material in a frozen-up spout. In addition to these purely metallurgical effects, such gas treatment can also be used to control the flow of metal, and the casting jet, in the sense that it may be used as a braking or throttling means. In some cases, the introduction of the gas directly into the passage opening of the particular brick has proven merely advantageous; in other cases, it has proven to be unavoidably necessary.

To the foregoing end, it has been known to supply the gas by making the entire brick, or at least that part of the brick in the immediate vicinity of the metal passage opening, from a porous refractory material and thereafter, forcing the gas through the pores under increased pressure. However, this method of supplying the gas has not proven satisfactory because the porous, that is, the gas-permeable material, has inadequate wear resistance. As a result, it fails to meet the service life requirements under normal operating conditions, as occur when molten steel flows along the wall portions of the passage opening.

In Austrian Pat. No. 1,314,114, a firebrick has been suggested which is provided with a passage opening for molten metal and with a plurality of gas ducts passing through the brick and which, at their outer ends, are connected to a feed conduit, and, at their inner ends, issue into the molten passage opening. These gas lines have a constant cross section over their entire length which, when relatively large, allows the molten metal moving through the passage opening to flow into the gas line if the gas pressure is inadequate. This prevents further flowing of the gas. It has, however, heretofore proved impossible, within the framework of firebrick manufacture, to form bricks having gas ducts with a very small diameter, preferably of no more than a few tenths of a millimeter, which would prevent the penetration of the molten metal into the gas duct. Bricks, commonly used, are made from a material containing a high portion of crude carborundum. Due to the high level of hardness of such material, it is impossible to use conventional tools to produce bores in cured or finished burnt bricks having the necessary small diameter for the desired gas lines.

It is the object of the present invention to provide a firebrick of the type described herein, and a method for manufacturing the same, which overcome the disadvantages of the prior art.

It is a further object of the present invention to provide a firebrick for use in the feeding of molten metal, which maintains the requisite wear resistance to the molten metal and permits the introduction of the treatment gas without any danger of the molten metal penetrating into the gas duct.

It is a further object of the present invention to provide an improved method for manufacturing shaped firebrick.

The foregoing objects, together with other objects and advantages, will be apparent from the following disclosure.

SUMMARY OF THE INVENTION

According to the present invention, a firebrick such as that used for the lip or inlet mouth of a ladle valve, spout, nozzle or the like for feeding molten metals is provided, comprising a shaped refractory body having an elongated passage for the molten metal and at least one conduit extending from the exterior of the body into communication with the passage for the introduction of gas therethrough. The conduit is reduced at least at its inner end adjacent the passage to a diameter the size of a capillary tube.

The conduit for the introduction of air can be made by boring the body, before curing or being burnt, using a small bit or needle to open up the capillary passage on the inner end. On the other hand, if the body is formed by casting or molding using a die core for the central passage, the capillary tube and/or the conduit can be formed by including with the core a die element for the capillary tube and the conduit or a separate element containing the capillary tube which becomes embedded in the body. Still further, the body can be formed in the manner now known with a conduit of relatively large diameter and thereafter closing the inner end with a plug or insert in which the capillary tube has already been formed. In this manner, the plug or insert can be separately formed and the capillary tube provided with a greater degree of accuracy and control. The plug or insert can be inserted within the conduit, in uncured condition and thereafter cured or burnt together with the body as a whole. In this case, the curing of the body causes it to shrink, thus holding the plug or insert under close fit. The plug may also be adhered by the use of suitable molding compounds, such as refractary mortar or cement.

Full details of the present invention are set forth in the following description of the preferred embodiments and are shown in the accompanying drawings.

DESCRIPTION OF THE INVENTION

Figure 1:
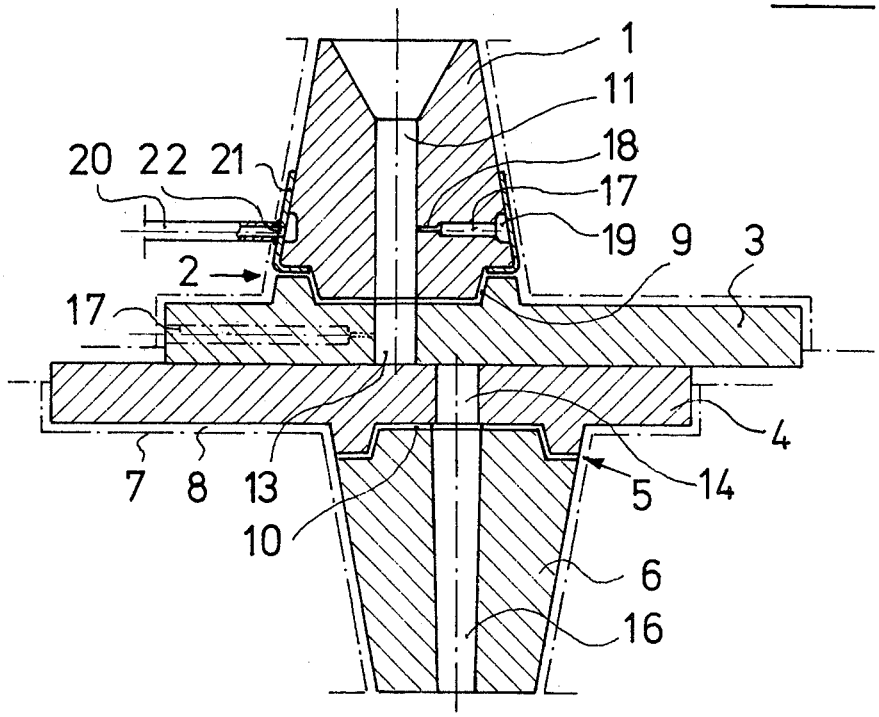
FIG. 1 is a vertical section of a firebrick including a gas conduit formed in accordance to the present invention.

For illustrative purposes, FIG. 1 shows the firebrick in the form of the lip or inlet mouth portion of a plate slide valve spout adapted to be incorporated in a ladle for feeding molten metal. Incorporation of the present invention in other devices will be apparent from this illustration. As seen in FIG. 1, the apparatus comprises a conically shaped sleeve 1 formed of refractory ceramic material mounted on conically centering arrangement, generally depicted by the numeral 2, extending from a fixed base plate 3. Mounted below the base plate 3 is a movable sliding valve plate 4 on which is centered a spout 6 similarly formed of ceramic material and keyed to the base plate 4 by a conically centering arrangement generally indicated by 5.

The dotted lines designate the contours of a housing or other apparatus to which the members are connected. Between these housing parts 7 and the sleeve 1, as well as between the individual elements 1, 3 or 4, 6, mortar joints 8, 9 and 10 are provided, which, on the one hand, serve to embed the individual elements and, on the other hand, serve as a seal, functioning to prevent escape of the molten metal. Extending in axial alignment through the sleeve 1 and the base plate 3 is a passage indicated by the numerals 11 and 13 for the molten fluid therethrough from the ladle. Similarly, an outlet passage extends in axial alignment through the valve plate 4 and the spout 6, generally defined by the numerals 14 and 16. By movement of the valve plate 4 relative to the base plate 3, the inlet passage 11, 13 can be made to be selectively aligned with the outlet passage 14, 16; thereby, a given quantity of molten material can be delivered from the ladle to the casting or molding die.

In general, the material and construction of the elements described above will follow those criteria already well known in the art. Accordingly, further description here is unnecessary.

In accordance with the present invention, however, the wall of the sleeve 1 is provided with a generally transverse conduit 17 for the introduction of gas into the passage 11. This conduit ends in a substantially reduced diameter portion 18 at its end adjacent the inlet passage 11 to form an extremely narrow duct or capillary tube, opening or issuing directly into the passage 11. Preferably, the size of the capillary tube 18 does not exceed 1 mm. An annular groove is formed about the outer periphery of the sleeve 1 connecting the outer end of the gas conduit 17 with a supply line 20, which is itself connected to a source of gas under pressure. Preferably, the supply line 20 is connected to a nipple 22 integrally formed on a sheet metal shell 21 which is adapted to cover the annular duct 19. The sheet metal cover 21 has a shape conforming to that of the sleeve 1, so that it can be held firmly impressed in place by a force fit, although a compound may be used to adhere the same.

Figure 2:
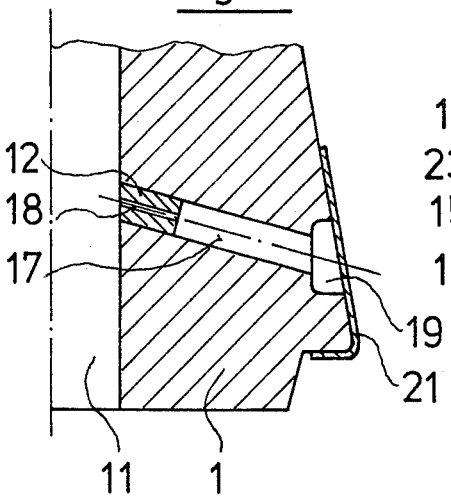
FIG. 2 is an enlarged view of a portion of the firebrick illustrated in FIG. 1, showing a variant of the gas conduit.
Figure 3:
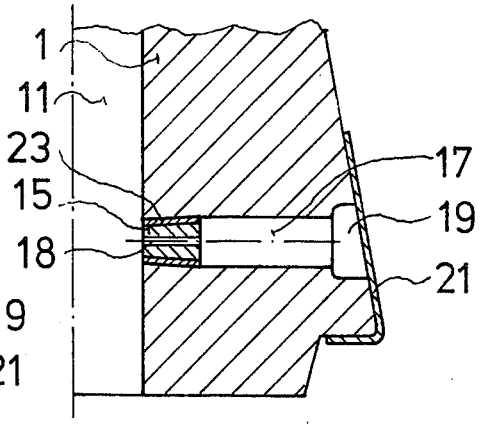
FIG. 3 is a view similar to that of FIG. 2, showing still a further embodiment.

FIG. 1 illustrates, in full lines, a single gas conduit 17, although it will be clearly understood that additional gas conduits, in any number, could, in fact, be arranged about the passage 11, being supplied via the common annular duct 19. The gas conduit 17 need not be perpendicular to the axis of the passage 11, but could instead be inclined toward or against the flow direction of the molten metal through the passage 11 as illustrated in FIGS. 2 or 3. The exact number of gas ducts, and their angular direction, is to be determined by the requirements of the feeding and/or casting operation. FIG. 1, however, shows in dotted lines an additional gas conduit 17' located on the fixed base plate 3. This illustrates the fact that the gas conduits can be arranged in various parts of the device, including the base plate. This latter conduit is connected to the source of gas in similar manner to that previously described.

Thus, the resistance to wear of the firebrick material forming the body of the inlet member is insured if the area in the vicinity of the passage 11 for a depth of about 20–25 mm. remains substantially unweakened, even though the remainder of the gas conduit is made relatively large diameter. The use of a capillary conduit of this depth in fact ensures such strength. Further, since the capillary tube has an extremely small diameter, it is effectively prevented from being blocked or frozen with the molten metal passing through the passage 11.

In FIGS. 2 and 3, further embodiments of the present invention are illustrated. In these embodiments, the gas conduits 17 are formed in the firebrick sleeve 1 in an analogous manner to that previously illustrated in FIG. 1, except that the enlarged diameter portion is made to extend from the outer surface all the way through to the inner passage 11. In FIG. 2, the conduit 17 is uniform in cross section and cylindrical along its entire length and a plug 12 of conforming cylindrical shape is inserted at the end of the conduit 17 adjacent the passage 11. In FIG. 3, the inner end of the conduit is tapered conically inward and a conforming plug 15 is inserted therein. Both plugs 12 and 15 contain a capillary tube 18 along its central axis, in a manner shown in FIG. 1.

Both plugs 12 and 15 may be constructed of ceramic material, or other material suitable for withstanding corrosion and all the effects of the molten metal. It is noted that in FIG. 2, the duct 17 has an upwardly extending angle and so the capillary tube issues against the flow of molten metal passing through the passage 11. Further in FIG. 2, the plug 12 is of conforming diameter to that of the conduit 17, so that it has to be force-fit to seat therein. This plug is preferably inserted in the conduit, before the firebrick is cured or burnt, so that the firebrick will shrink about the plug 12 holding the same in place. In FIG. 3, the plug 15 is illustrated as being held in place by the insertion of an adhesive compound or sealing compound, such as mortar or cement 23. Combinations of force-fit and sealing compound can be of course used. Otherwise, the features described in connection with FIG. 1 can be carried forward in either of the embodiments shown in FIGS. 2 or 3.

According to the present invention, the method for manufacturing a firebrick containing capillary gas conduit is also provided. In this connection, the firebrick, such as the sleeve 1, can be made of conventional materials and shaped and formed in otherwise conventional manner. Preferably, the capillary tube 18 is thereafter formed together with the conduit 17 in the firebrick, prior to the brick being burnt or cured. Because the conduit 17 and the capillary tube are thus formed prior to curing, conventional tools can be used to drill or needle punch the capillary tube 18. A needle may be inserted in the raw fire brick and removed after the firebrick is cured and burnt to leave the capillary opening. It is also possible to produce the enlarged conduit opening after curing by drilling. The capillary tube can also be perforated by means of a needle or similar punched by a very fine drill bit. Because of the rather short length of the capillary tube within the wall, conventional tools can be used.

The present invention also permits a rather simple process for manufacture when the firebrick is cast or molded. The gas conduit line 17 and the capillary tube can be formed by employing a suitable die core within the mold. Since the enlarged conduit portion 17 is on the exterior surface of the sleeve, the die core can be easily removed from the cast or molded sleeve upon its being removed from the mold.

In the embodiments shown in FIGS. 2 and 3, the process is even further simplified by forming the wide diameter conduit 17 within the sleeve 1 by any means. Since the entire length of the conduit 17 extends from surface to surface, formation of such a conduit can be easily made by anyone of the preceeding steps. The plugs 12 and 15 containing the capillary tubes can then be made separately by any usual molding or casting method, or by a simple working of a cylindrical or conical plug to form the central capillary. The plugs 12 and 15 may thereafter be placed into the conduit 17, and secured therein either before or after burning the brick.

In the foregoing, it will be appreciated that reference to a capillary tube would also include the reference to a formation of a capillary bore. In addition, it is to be noted that the capillary 18 extends coaxially with the axis of conduit 17, although this is not a critical feature. Burning or curing of the brick is made in conventional manner.

It will be seen from the foregoing that the present invention provides an improved firebrick, with conduits for the introduction of gas into a molten metal stream. Various embodiments, changes and modifications have been described. Others will be obvious to those skilled in the art. Accordingly, it is intended that the present invention be taken as illustrative only and not limiting of the scope of the invention.

What is claimed is:

1. A firebrick for the use in feeding molten metal, comprising a shaped refractory body having an elongated passage for the molten metal, and at least one conduit extending from the exterior of said body into communication with said passage for the introduction of gas thereto, a plug located at the inner end of said conduit, said plug having a bore reduced in diameter at least at its inner end adjacent the passage to the size of a capillary.

2. The firebrick according to claim 1, wherein said reduced diameter capillary tube has a diameter of less than 1 mm.

3. The firebrick according to claim 1, wherein the plug member is a ceramic body secured within said conduit by a refractory molding compound.

4. The firebrick according to claim 1, wherein the plug member is conically tapered and said conduit is conformingly shaped to receive the same.

5. The firebrick according to claim 1, wherein the plug member is force-fit within said conduit.

* * * * *